United States Patent [19]

May et al.

[11] Patent Number: 5,036,997

[45] Date of Patent: Aug. 6, 1991

[54] STAY-OPEN TOWEL DISPENSING CONTAINER

[75] Inventors: Timothy J. May, Outagamie; Robert Styer; Mark Ericson, both of Fond du Lac, all of Wis.

[73] Assignee: Reynolds Consumer Products, Inc., Richmond, Va.

[21] Appl. No.: 566,086

[22] Filed: Aug. 10, 1990

[51] Int. Cl.[5] ..... B65D 43/24

[52] U.S. Cl. ..... 220/335; 220/4.22; 220/337; 220/355; 229/125; 229/125.08

[58] Field of Search ..... 220/335, 337, 339, 264, 220/306, 355, 356, 4.22, 4.23; 229/125, 125.08

[56] References Cited

U.S. PATENT DOCUMENTS

| | | | |
|---|---|---|---|
| 3,240,375 | 3/1966 | Burrows . | |
| 3,272,379 | 9/1966 | Driza et al. . | |
| 3,621,115 | 11/1971 | Kolster | 220/339 X |
| 4,005,800 | 2/1977 | Schurman | 220/337 |
| 4,291,818 | 9/1981 | Nozawa et al. | 220/335 |
| 4,574,944 | 3/1986 | Gregory . | |
| 4,696,412 | 9/1987 | McGowan et al. | 220/335 |
| 4,795,065 | 1/1989 | Ashizawa et al. . | |
| 4,969,574 | 11/1990 | Shastal | 220/269 |
| 4,971,220 | 11/1990 | Kaufman et al. | 220/335 |

*Primary Examiner*—Stephen Marcus
*Assistant Examiner*—Stephen Cronin
*Attorney, Agent, or Firm*—Alan T. McDonald

[57] ABSTRACT

At least one lug formed on the inside of the cover of a plastic container contacts a lip provided on the top back edge of the container bottom when the cover is opened to a predetermined position so that the cover is releasably held open.

10 Claims, 2 Drawing Sheets

STAY-OPEN TOWEL DISPENSING CONTAINER

BACKGROUND OF THE INVENTION

This invention relates to containers and more particularly to molded plastic containers designed to retain their cover in an open position.

Molded plastic containers are now available for a variety of uses. However, these containers, some of which have been molded flat, have a tendency, when the cover is not held to the bottom, to pull the cover rearwardly into a flat open position because the hinge develops a memory. At the same time, plastic containers, which have not been molded flat or which are molded in two pieces with the cover hinged to the bottom, have a tendency, when the cover is not held open, to remain in a shut or closed position. Thus, for example, a consumer who desires to retrieve material from the container is forced to raise the cover each time they desire to retrieve an article. In the case of moist towels, for baby care, the user may be forced to raise the cover several times in a short time span.

One solution, disclosed in U.S. Pat. No. 3,240,375, is to provide a pair of lugs on the outer rear side of the cover that cooperate with fingers located on the outer rear side of the bottom. One lug/finger combination prevents the cover from fully opening. The other lug/-finger combination holds the cover from moving into the closed position once the cover has been opened a predetermined amount.

Another solution, disclosed in U.S. Pat. No. 4,574,944, is to provide an outwardly projecting element on the rear side of the cover which contacts a complimentary outwardly projecting member on the rear side of the bottom to hold the cover in an open position at an angle greater than 90° from the closed position.

The problem with these solutions is that they require two complementary projections which increases the complexity of the mold. Furthermore, one is not able to fully open the cover. The present invention provides for a single molded feature on the inside of the cover which contacts the rear wall of the bottom of the container to hold the cover open even if one fully opened the cover.

SUMMARY OF THE INVENTION

The invention provides a container with means for releasably holding the cover open. The container has a cover and a bottom. The cover has a front wall, a rear wall, sides, and a tongue integrally formed on the rear wall that extends outward. The bottom also has a front wall, a rear wall, and sides. The bottom walls and sides have a lip at their ends which nest with the cover when the cover is in a closed position. In addition, the bottom has a tongue integrally formed on the lip of the rear wall that extends outward. The bottom tongue is bonded or joined to the top tongue along a substantial portion of its length.

The cover has a means for releasably holding the cover open, molded on the inside of the top of the cover adjacent the rear wall of the cover and extending downward such that when the cover is raised beyond a predetermined position, the holding means will contact the lip on the rear wall of the bottom to hold the cover in a predetermined open position.

DETAILED DESCRIPTION OF THE INVENTION AND PREFERRED EMBODIMENTS

Figure 1:
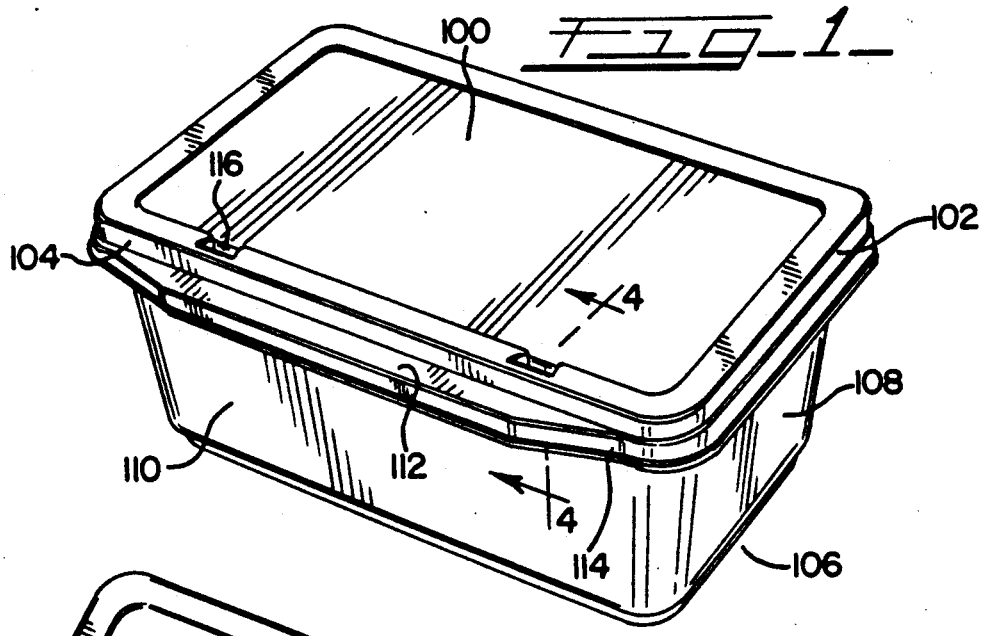
FIG. 1 is a perspective view of a container of the preferred embodiment of the invention in a closed position.

FIG. 1 illustrates a container in a closed condition having a cover 100 with front wall (not shown), rear wall 104, and sides 102. The container is preferably molded from plastic. The container also has a bottom 106 with front wall (not shown), rear wall 110, and sides 108. Cover 100 has a tongue 112 with two edges 114 integrally formed on and extending outwardly from the rear wall 104 of cover 100. Edges 114 are located near sides 102 and extend outward at an angle towards the middle of the container.

Figure 2:
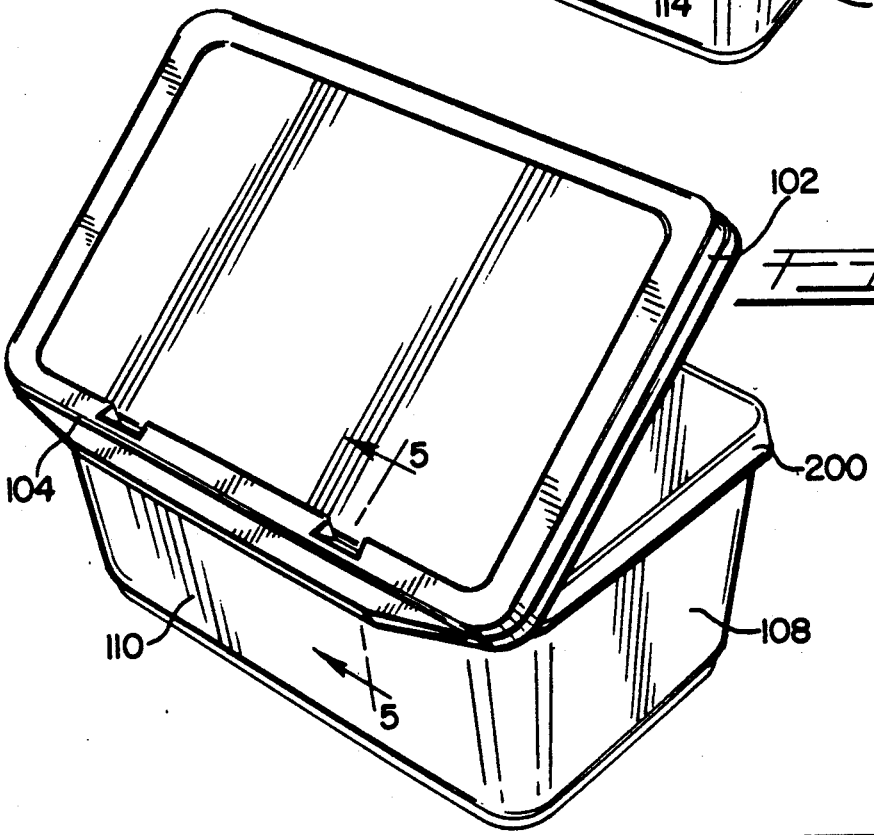
FIG. 2 is a perspective view of the container of FIG. 1 in the predetermined open position.

FIG. 2 shows a lip 200 provided at the top of sides 108, rear wall 110, and front wall that will nest with sides 102, rear wall 104, and front wall on cover 100 when cover 100 is in the closed position. Bottom 106 also has tongue 400, best seen in FIG. 4, that is integrally formed on the rear side of lip 200 and extends outward.

Top tongue 112 and bottom tongue 400 are bonded or joined along a substantial portion of their length preferably by spot welds 300 (shown in FIG. 3), to form a hinge. Thus, cover 100 is swingably hinged to bottom 106. In a preferred embodiment top tongue 112 and bottom tongue 400 are joined along their length up to about one inch from each edge 114 of tongue 112.

Figure 3:
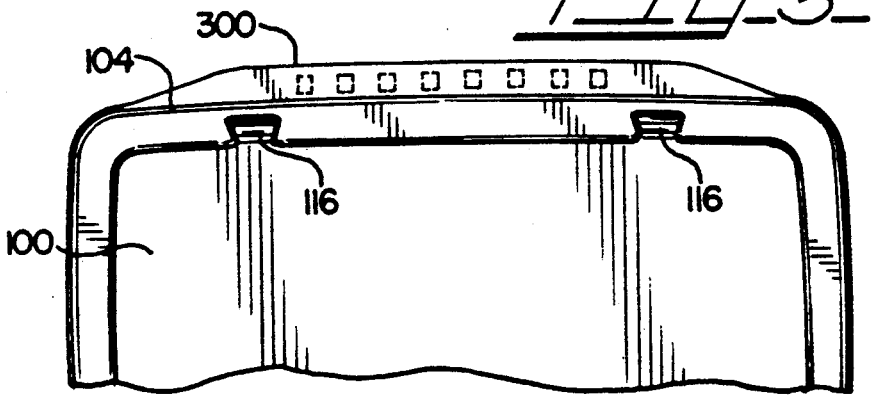
FIG. 3 is a top plan view of a portion of the rear of the container of FIG. 1.

The container is also provided with two lugs 116 formed on cover 100 and extending downward. The lugs 116 are located adjacent the rear wall 104 of cover 100. In a preferred embodiment, the lugs 116 are spaced apart a distance greater than the length of the bonded or joined portion of the tongues 112 and 400. In a more preferred embodiment, the lugs 116 are located between the edge 114 of tongue 112 and the end of the series of spot welds 300, as best seen in FIG. 3. In an alternative embodiment, a single lug is formed in the top of the cover 100 extending downward, adjacent the rear wall of the cover and located near one side of the cover. In this embodiment, the lug is located off-center, that is, in a position similar to one of the lugs 116 shown in FIG. 3.

Figure 4:
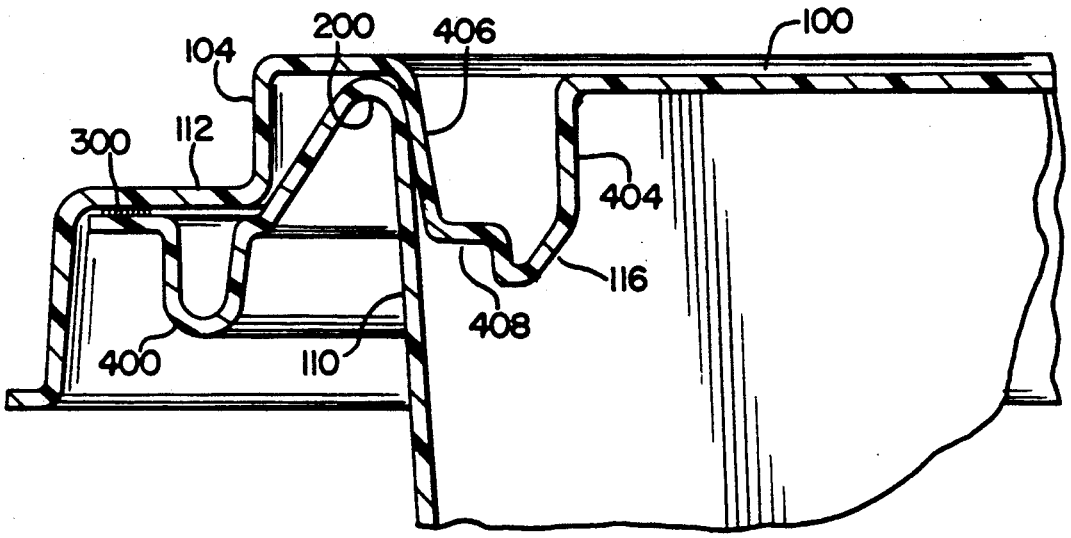
FIG. 4 is an enlarged cross section of the container taken along line 4—4 of FIG. 1.

The lugs 116, as shown in FIG. 4, each have a front portion 404 and a rear portion 406. Rear portion 406 is angled slightly from the vertical such that when cover 100 is in the closed position, the distal end of lug 116 is spaced from the inside of bottom rear wall 110. Lugs 116 are each also provided with a step 408 located near the bottom of rear portion 406.

Figure 5:
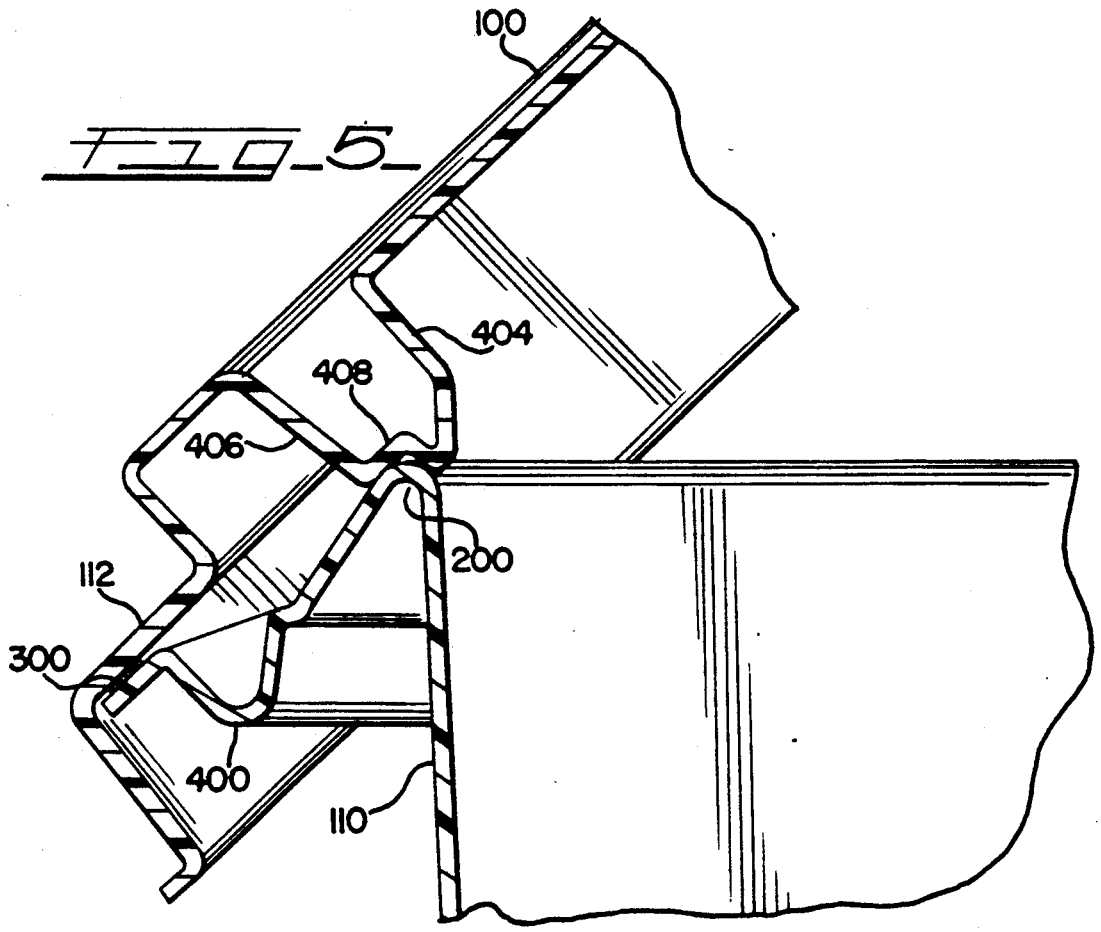
FIG. 5 is an enlarged cross section of the container taken along line 5—5 of FIG. 2.

When the cover 100 is lifted to an open position, rear portion 406 of lug 116 rides along the inside of rear wall 110 causing the rear wall 110 to flex outwardly until step 408 contacts lip 200 to hold cover 100 open at a predetermined position, as shown in FIG. 5. Furthermore, when cover 100 is lifted beyond the predetermined open position, bottom tongue 400 distorts and acts to urge cover 100 to a closed position, forcing step 408 into engaging contact with lip 200 to hold cover 100 open. When cover 100 is moved to a closed position, step 408 acts against the lip 200 of rear wall 110, causing rear wall 110 to flex outwardly until step 408 slidably disengages contact with lip 200, allowing the cover 100 to be closed.

It has been found that the proper position of the lugs 116 depends on: the stiffness of the plastic used for the rear wall 110, the length of the tongues 112, 400, and the length of the bonded or joined together portion of the tongues 112, 400. Because the tongues are joined only along a substantial portion of their entire length, when the cover 100 is lifted to an open position, the unjoined portions of the tongues are free to flex or separate from each other, thus providing the necessary distortion to allow the lugs 116 to slideably engage and disengage contact with lip 200. When the lugs are located too close together, or one lug is located in the center, the rear wall 110, which is more flexible at its center than at its sides, flexes too much and the cover does not stay open. Conversely, when the lugs are located too far apart, or too close to sides 102, where the rear wall 110 is stiffer, the cover 100 is not easily raised or lowered. In a preferred embodiment where the container is about 8 inches long, the tongues 112 and 400 are about 5 inches in length, the tongues are joined together by a series of spot welds 300, the series being about 3 inches long, and each lug 116 is spaced about 2 inches off from the side-to-side center of the container.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention.

We claim:

1. A stay-open container comprising:

a. a cover having a top, a front wall, a rear wall, and sides;

b. a top tongue integrally formed on the rear wall of the cover and extending outward;

c. a bottom having a base, a front wall, a rear wall, and sides, the walls and the sides having a lip adapted to nest with the walls and the sides of the cover;

d. a bottom tongue integrally formed on the lip of the rear wall of the bottom and extending outward, the bottom tongue being joined to the top tongue along a portion of the length of the tongue; and e. at least one lug formed in the top of the cover extending downward adjacent the rear wall of the cover and spaced from the side-to-side center of the container, the lug contacting the lip on the rear wall of the bottom when the cover is opened to a predetermined position to releasably hold the cover in the predetermined open position.

2. The container of claim 1 where the bottom tongue is joined to the top tongue at the center portion of the tongue up to about one inch from each edge of the tongue.

3. The container of claim 1 where there are two lugs spaced apart a distance greater than the length of the joined together portion of the tongues.

4. The container of claim 3 where the lug has a step formed near the bottom of the rear portion of the lug to contact the lip on the rear wall of the bottom.

5. A molded stay-open container comprising:

a. a plastic cover with a top, a front wall, a rear wall and two sides;

b. a top tongue integrally formed on the rear wall of the cover and extending outward;

c. a plastic bottom with a base, a front wall, a rear wall, and two sides, the walls and the sides having a lip adapted to nest with the walls and the sides of the cover;

d. a bottom tongue integrally formed on the lip of the rear wall of the bottom and extending outward, the bottom tongue being bonded to the top tongue along a portion of the tongue; and e. at least one lug formed in the top of the cover extending downward, spaced from the side-to-side center of the container and adjacent the rear wall of the cover, the lug contacting the lip on the rear wall of the bottom when the cover is opened to a predetermined position to releasably hold the cover in the predetermined open position.

6. The container of claim 5 where the bottom tongue is joined to the top tongue at the center portion of the tongue up to about one inch from each edge of the tongue.

7. The container of claim 5 where the lug has a step formed near the bottom of the rear portion of the lug to contact the lip on the rear wall of the bottom.

8. The container of claim 5 where there are two lugs spaced distance greater than the length of the joined together portion of the tongues.

9. A molded plastic stay-open towel dispensing container comprising:

a. a cover with a top, a front wall, a rear wall and two parallel sides;

b. a top tongue integrally formed on the rear wall of the cover and extending outward;

c. a bottom with a base, a front wall, a rear wall, and two parallel sides, the walls and the sides having a lip adapted to nest with the walls and the sides of the cover;

d. a bottom tongue integrally formed on the lip of the rear wall of the bottom and extending outward, the bottom tongue being bonded to the top tongue along the length of the tongue not including about one inch from each edge of the tongue; and e. two lugs formed in the top of the cover adjacent the rear wall, extending downward, and spaced apart a distance greater than the length of the joined together portion of the tongues, the lugs having a step formed near the bottom of the rear portion of the lug so that the step contacts the lip on the rear wall of the bottom when the cover is opened to a predetermined position so as to releasably hold the cover in the predetermined open position.

10. The container of claim 9 where the cover is held open at an angle of about approximately forty five degrees.

* * * * *